US009166342B1

(12) United States Patent
Tao et al.

(10) Patent No.: US 9,166,342 B1
(45) Date of Patent: Oct. 20, 2015

(54) ELECTRICAL CONNECTOR

(71) Applicants: Wusong Tao, Dongguan (CN); Yu Wang, Dongguan (CN)

(72) Inventors: Wusong Tao, Dongguan (CN); Yu Wang, Dongguan (CN)

(73) Assignee: FREEPORT RESOURCES ENTERPRISES CORP., Dongguan, Guangdong (CN)

( * ) Notice: Subject to any disclaimer, the term of this patent is extended or adjusted under 35 U.S.C. 154(b) by 17 days.

(21) Appl. No.: 14/254,344

(22) Filed: Apr. 16, 2014

(51) Int. Cl.
*H01R 13/648* (2006.01)
*H01R 13/6581* (2011.01)
*H01R 13/40* (2006.01)

(52) U.S. Cl.
CPC ..... *H01R 13/6581* (2013.01); *H01R 13/40* (2013.01)

(58) Field of Classification Search
USPC ..... 439/607.27, 607.55
IPC ..... H01R 13/65802,13/658, 23/6873, 23/7073
See application file for complete search history.

(56) References Cited

U.S. PATENT DOCUMENTS

| | | | | |
|---|---|---|---|---|
| 6,280,252 | B1 * | 8/2001 | Huang | 439/607.48 |
| 7,273,397 | B2 * | 9/2007 | Watanabe et al. | 439/607.27 |
| 7,690,948 | B2 * | 4/2010 | Lung | 439/607.27 |
| 8,961,230 | B2 * | 2/2015 | Chou | 439/607.27 |

* cited by examiner

*Primary Examiner* — Hien Vu

(57) ABSTRACT

An electrical connector includes an insulating body, a terminal set, a wire, and a shielding housing having an upper shell body and a lower shell body. A support part of the first buckling sheet which is penetrated through a first buckle hole of the lower shell body is rivetedly pressed on an outer peripheral edge of the first buckle hole of the lower shell body. An upper side and a lower side of the wire are pressed by a top plate of the upper shell body and the bottom plate of the lower shell body so that the upper and lower shell bodies of the shielding housing can be integrally formed, thereby promoting the bulk intensity of the produced electrical connector, preventing the internal mechanism of the electrical connector from damage due to the oscillation of the wire, and promoting the reliability of the produced electrical connector.

6 Claims, 7 Drawing Sheets

ELECTRICAL CONNECTOR

BACKGROUND OF THE INVENTION

1. Field of the Invention

The present invention relates to technical fields of electrical connectors, and in particular relates to a HDMI electrical connector.

2. Description of the Related Art

Conventionally, a High-Density Multichip Interconnect (HDMI) electrical connector includes an insulating body, a terminal set insertedly mounted in the insulating body, a wire connected to a rear end of the terminal set, and a shielding housing sleeved outside the insulating body to form a connection plug.

The shielding housing generally includes a front shell and a rear shell that are commonly designed as two individual parts, in which the front shell is utilized to sleeve outside the insulating body, and the rear shell is utilized to wrap on a wired position of the wire and the terminal set to tightly clamp a rear end of the wire. In the present market, different types of rear shells such as an integrally-formed rear shell and a split-type rear shell having an upper shell body and a lower shell body that are mutually engaged are provided.

In the assembling process of the integrally-formed rear shell, a rear end of a wire, which is penetrated in an interior of the rear shell, is moved forward to engage the front shell. In an actual application, because too many components of the front and rear shells exists in a wired position of the wire and the terminal set and geometric structure thereof cannot be perfectly flatten, the rear shell is possibly blocked and not allowed to insertedly engage with the front shell if any protrusion is existed thereon. Therefore, the internal components of the front and rear shells must be manually pressed and ordered so that a reassembling process can be smoothly performed again, resulting in problems of installation inconvenience, time-consuming and requiring strenuous effort.

In the design structure of the mutually-engaged upper and lower shell body of the rear shell, a limit clamping force produced from the engagement structure of a convex hull and a concave slot is limited. When the tail of the forced wire has a large oscillation amplitude, the internal components of the upper and lower shell body of the rear shell are easily loosened, or even the engagement structure is disengaged, deformed, warped or fallen off, resulting in weak assembly strength and short life service.

Basically, the size specification of the connection plug of the conventional HDMI electrical connector is generally standardized. Except the connection plug, other parts of the HDMI electrical connector can be dimensionally produced according to requirements. In the basic size of the conventional HDMI electrical connector, the length of the tongue piece is 12 mm, the sum of the lengths of the base seat and the tongue piece is 17 mm, the sum of the lengths of the base seat, the tongue piece and the wire clip is 20 mm, and the width of the wire clip is 15 mm. Besides, the width of the rear shell is 17.5 mm, the length measured from a front edge of the front shell to a rear edge of the bottom plate of the rear shell is 31 mm, the entire length measured from a frontmost edge of the front shell to the rear edge of the bottom plate of the rear shell is 31 mm, the entire length measured from a frontmost edge of the front shell to a rearmost end of the rear shell is 37 mm. However, due to a predetermined space to be required for the wired position of the adjacent terminals, it is difficult to realize product miniaturization for the requirement of market diversification.

BRIEF SUMMARY OF THE INVENTION

The main purpose of the invention is to provide an electrical connector, in which buckle holes of a lower shell body are riveted to buckling sheets of an upper shell body so as to integrally form the upper and lower shell bodies into one piece, thereby effectively promoting the bulk intensity of the produced electrical connector. Accordingly, the wire can be tightly pressed for avoiding excessive oscillation caused by the rear end of the clamped wire, thereby preventing the internal mechanism of the electrical connector from damage due to the oscillation of the wire and promoting the reliability of the produced electrical connector.

To realize the above purposes, the invention provides technical measures as follows.

An electrical connector comprises an insulating body, a terminal set insertedly mounted in the insulating body, a wire connected to a rear end of the terminal set, and a shielding housing comprising an upper shell body and a lower shell body that are vertically corresponded. The lower shell body comprises a front shell that is integrally extended from a front end thereof to sleeve outside the insulating body to form a connection plug, and the upper and lower shell body of the shielding housing are mutually fastened to wrap a wired position of the terminal set and the wire to form a wired chamber, characterized in that two side flange of a rear end of a bottom plate of the lower shell body are opened with first buckle holes, bottoms of a left-rear side plate and a right-rear side plate of the upper shell body are protrudingly configured with first buckling sheets, the first buckling sheet comprises a folded part and a support part penetrated through the first buckle hole of the lower shell body, in which, when bending the folded part of the first buckling sheet, the support part of the first buckling sheet is rivetedly pressed on an outer peripheral edge of the first buckle hole of the lower shell body, left and right sides of the wire are clamped by the left-rear side plate and the right-rear side plate of the upper shell body, and upper and lower sides of the wire are pressed by a top plate of the upper shell body and the bottom plate of the lower shell body.

In the invention, a rear end of the upper shell body is configured with the first buckling sheets, and a rear end of the lower shell body is configured with the first buckle holes. The first buckle holes of the lower shell body is riveted to the buckling sheets of the upper shell body so as to integrally form the upper and lower shell bodies into one piece, thereby effectively promoting the bulk intensity of the produced electrical connector. Two sides of the wire are clamped by the left-rear side plate and the right-rear side plate of the upper shell body, and the wire can be tightly pressed for avoiding excessive oscillation caused by the rear end of the clamped wire, thereby preventing the internal mechanism of the electrical connector from damage due to the oscillation of the wire and promoting the reliability of the produced electrical connector.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description taking a High-Density Multichip Interconnect (HDMI) electrical connector as an example, is of the best-contemplated mode of carrying out the invention. This description is made for the purpose of illustrating the general principles of the invention and should not be taken in a limiting sense of being applied in the HDMI electrical connector, viz. being applied in other connectors.

Referring to FIGS. 1 to 11, a concrete configuration of a preferred embodiment of the invention is illustrated. The electrical connector comprises an insulating body 10, a terminal set 20 insertedly mounted in the insulating body 10, a wire 30 connected to a rear end of the terminal set 20, and a shielding housing 40 wrapped on a wired position of the insulating body 10, the terminal set 20 and the wire 30. Accordingly, a HDMI connection plug can be formed.

Figure 4:
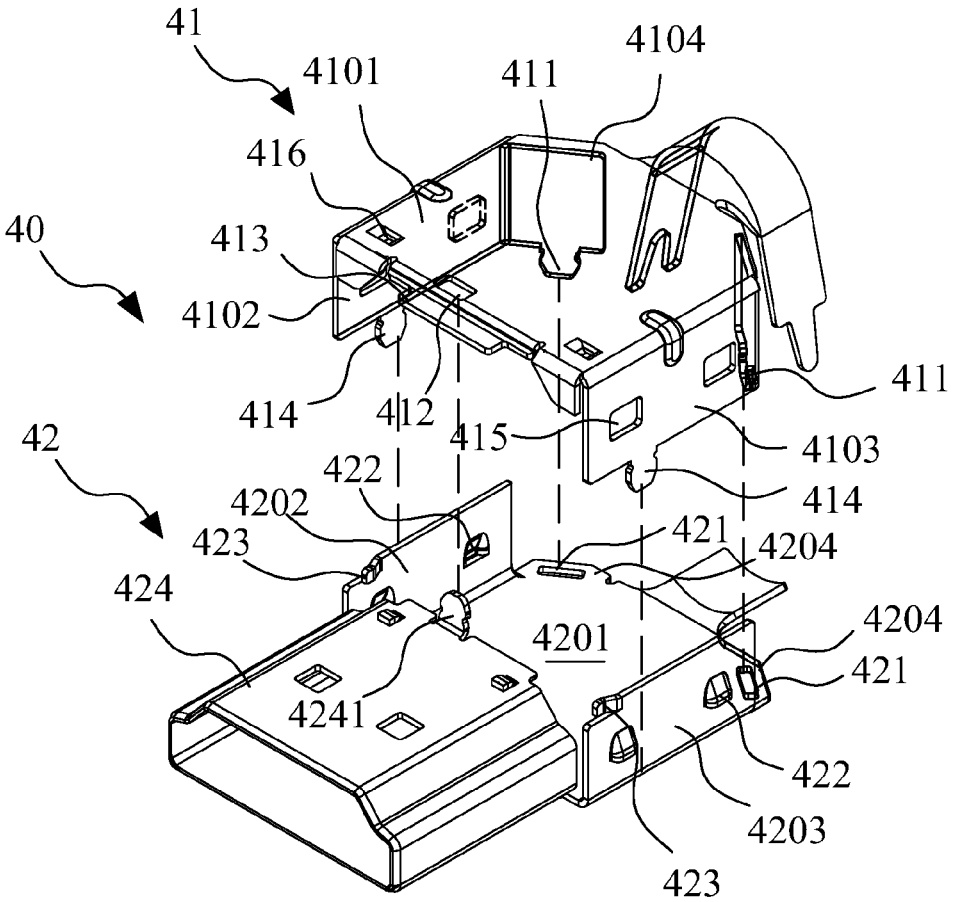
FIG. 4 is an exploded view illustrating an upper shell body and a lower shell body of the electrical connector in the embodiment of the invention.
Figure 5:
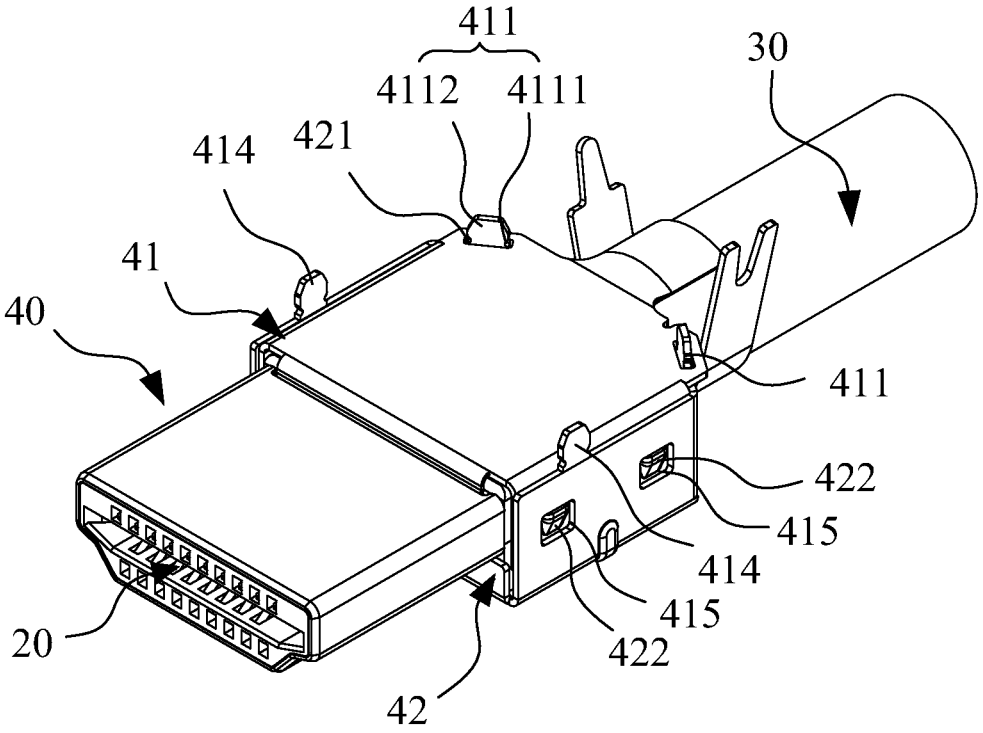
FIG. 5 is a state view illustrating the upper and lower shell bodies of the electrical connector which are engaged, prior to being riveted, in the embodiment of the invention.
Figure 6:
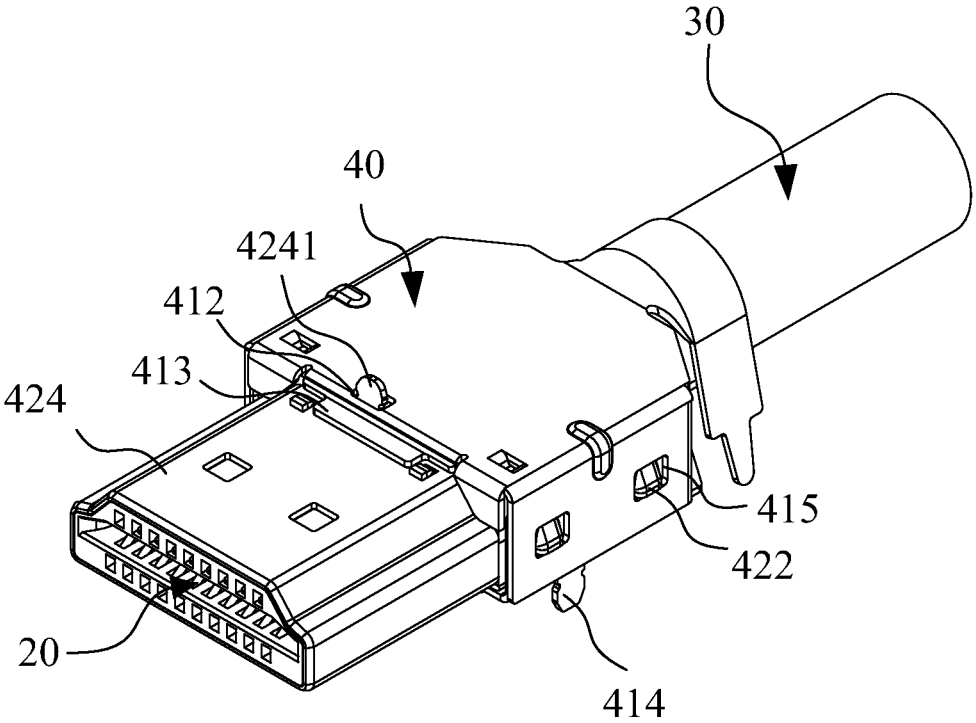
FIG. 6 is a rear view of FIG. 5.
Figure 7:
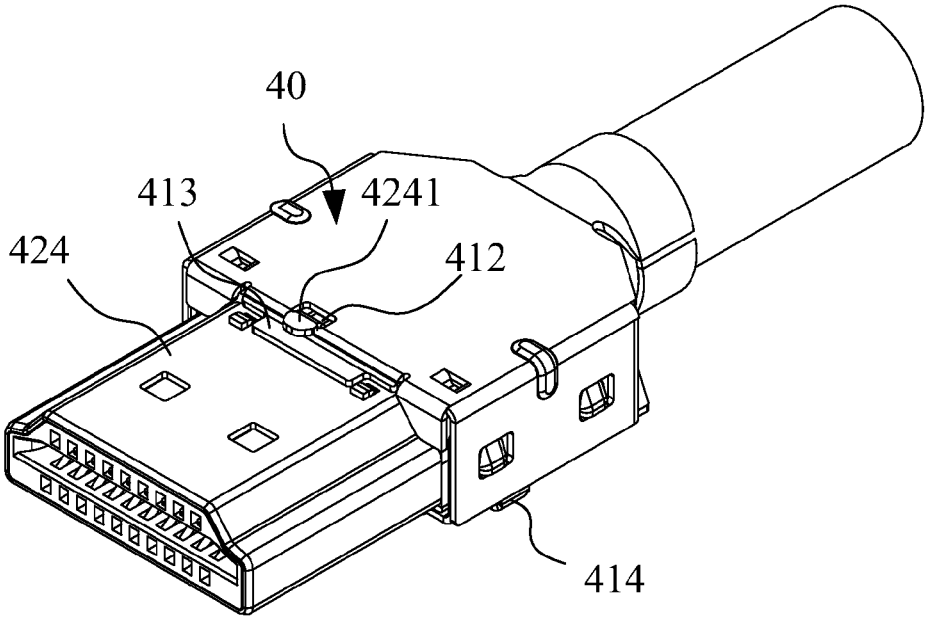
FIG. 7 is a state view illustrating an upper shell body and a lower shell body of the electrical connector which are riveted in the embodiment of the invention

As shown in FIGS. 4, 5 and 6, the shielding housing 40 comprises an upper shell body 41 and a lower shell body 42 that are vertically corresponded. The lower shell body 42 comprises a front shell 424 that is integrally extended from a front end thereof to sleeve outside the insulating body 10 to form a connection plug, and the upper and lower shell body 41 and 42 of the shielding housing 40 are mutually fastened to wrap a wired position of the terminal set 20 and the wire 30 to form a wired chamber.

Figure 3:
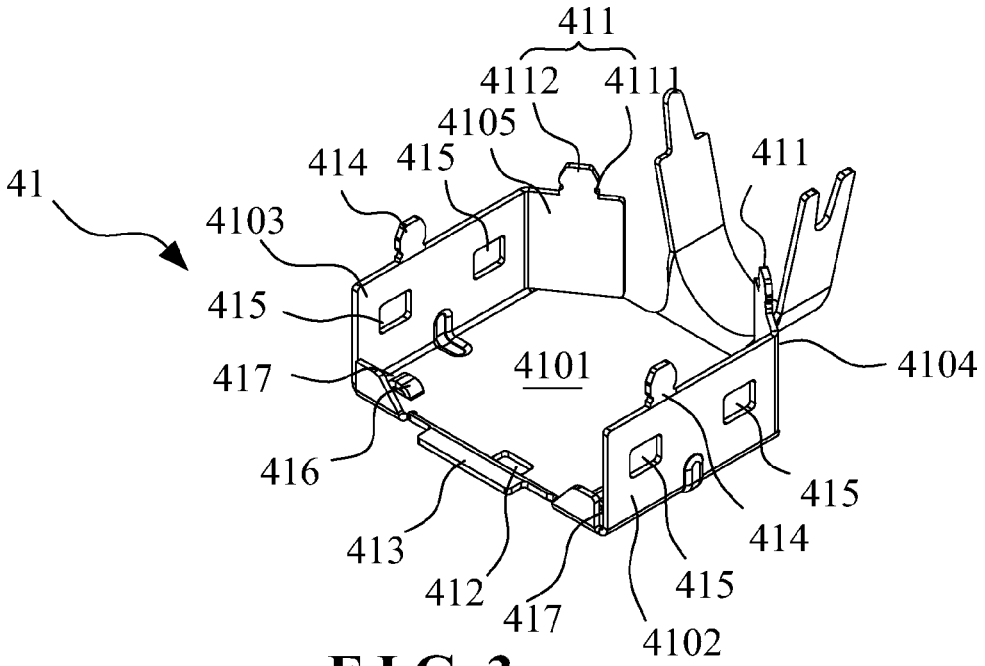
FIG. 3 is a schematic view illustrating an upper shell body of the electrical connector in the embodiment of the invention.

Concretely speaking, the upper shell body 41 shown in FIG. 3 comprises a top plate 4101, a first left side plate 4102 and a first right side plate 4103, in which the first left side plate 4102 and the first right side plate 4103 are extended downward from two sides of the top plate 4101. The lower shell body 42 shown in FIG. 4 comprises the bottom plate 4201, a second left side plate 4202 and a second right side plate 4203, in which the second left side plate 4202 and the second right side plate 4203 are extended upward from two sides of the bottom plate 4201. Two side flange 4204 of a rear end of a bottom plate 4201 of the lower shell body 42 are opened with first buckle holes 421, and bottoms of a left-rear side plate 4104 and a right-rear side plate 4105 of the upper shell body 41 are protrudingly configured with first buckling sheets 411. In FIG. 4, the first buckling sheets 411 of the upper shell body 41 are respectively engaged in the first buckle holes 421 of the lower shell body 42. The first buckling sheet 411 comprises a folded part 4111 and a support part 4111 penetrated through the first buckle hole 421 of the lower shell body 42. When the folded part 4111 of the first buckling sheet 411 is bent, the support part 4111 of the first buckling sheet 411 is rivetedly pressed on an outer peripheral edge of the first buckle hole 421 of the lower shell body 42 (shown in FIG. 8).

Figure 10:
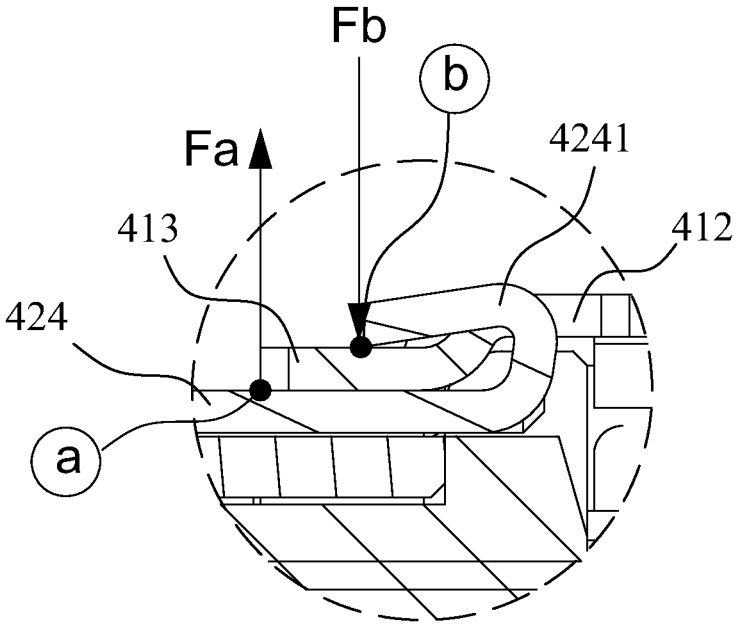
FIG. 10 is an enlarged view of 'A' region of the electrical connector in FIG. 9, illustrating a force state of a wire to be oscillated downward.
Figure 11:
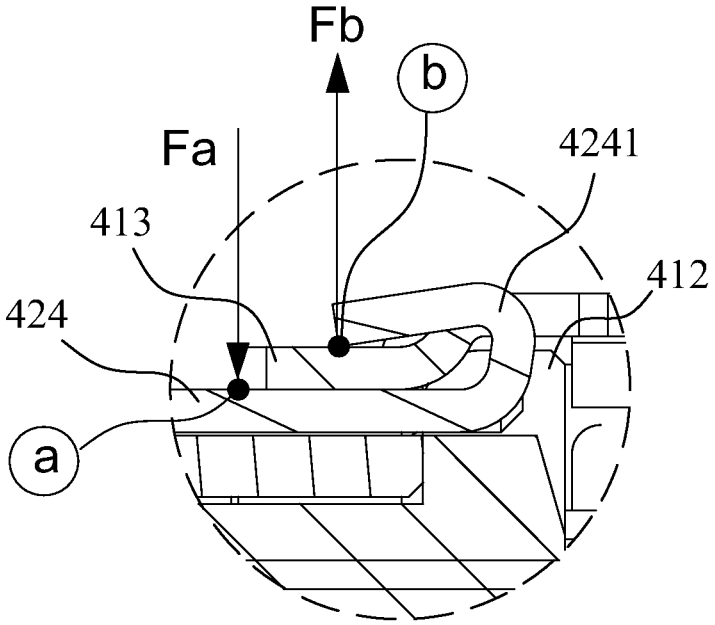
FIG. 11 is an enlarged view of 'A' region of the electrical connector in FIG. 9, illustrating a force state of a wire to be oscillated upward.

In FIGS. 3 and 4, a front side of the top plate 4101 of the upper shell body 41 is configured with a second buckle hole 412, a support arm 413 is extended from a front edge of the top plate 4101 of the upper shell body 41, a second buckling sheet 4241 extended upward from a rear edge of a top surface of the front shell 424 of the lower shell body 42 is engaged in the second buckle hole 412 of the upper shell body 41, and the second buckling sheet 4241 is folded to reversely buckle and press a peripheral edge of the second buckle hole 412 of the upper shell body 41 so that the support arm 413 of the upper shell body 41 and the top surface of the front shell 424 of the lower shell body 42 are mutually abutted (referred to FIGS. 10 and 11).

In FIG. 4, third buckling sheets 414 are protrudingly arranged on bottoms of the first left side plate 4102 and the first right side plate 4103 of the upper shell body 41, respectively. The second left side plate 4202 and the second right side plate 4203 of the lower shell body 42 are outwardly clamped by the first left side plate 4102 and the first right side plate 4103 of the upper shell body 41, and the third buckling sheets 414 of the upper shell body 41 are folded on bottom edges of the second left side plate 4202 and the second right side plate 4203 of the lower shell body 42 to reversely buckle the bottom plate 4201 of the lower shell body 42 (referred to FIG. 8).

Besides, as shown in FIG. 4, the first left side plate 4102 and the first right side plate 4103 of the upper shell body 41 are configured with a plurality of engaging holes 415, and the second left side plate 4202 and the second right side plate 4203 of the lower shell body 42 are configured with a plurality of convex points 422 which are engaged in the corresponding engaging holes 415 of the upper shell body 41 (referred to FIGS. 5 and 6). In FIGS. 3 and 4, both sides of a front end of the top plate 4101 of the upper shell body 41 is concaved downward with two concave points 416 which are respectively distanced from the first left side plate 4102 and the first right side plate 4103 with clearances 417, and front sides of top edges of the second left side plate 4202 and the second right side plate 4203 of the lower shell body 42 are configured with guide elastic pieces 423 which are slidably, tightly embedded in the clearances 417 of the upper shell body 41.

Accordingly, the engaging structures of the first buckling sheets 411 of the upper shell body 41 and the first buckle holes 421 of the lower shell body 42 are respectively configured on both sides of the bottoms of the rear ends of the shielding housing 40. The engaging structures of the second buckling sheet 4241 of the lower shell body 42 and the second buckle hole 412 of the upper shell body 41 is configured on the mutual superposition position of the front shell 424 of the lower shell body 42 and the upper shell body 41. The third buckling sheets 414 arranged on the left and right sides of the upper shell body 41 can be directly, inwardly bent so that the upper shell body 41 and the lower shell body 42 can be integrally riveted. In addition, with the engaging structure of the convex points 422 configured on the left and right side plates of the lower shell body 42 and the engaging holes 415 configured on the left and right side plates of the upper shell body 41, as well as the engaging structure of the guide elastic pieces 423 configured on the inner side of the lower shell body 42 and the clearances 417 formed on the upper shell body 41, the upper shell body 41 and the lower shell body 42 of the shielding housing 40 can be integrally formed by riveting along different orientations. Further, with the left and right sides of the wire 30 to be clamped by the left-rear side plate 4104 and the right-rear side plate 4105 of the upper shell body 41, as well as the upper and lower sides of the wire 30 to be pressed by a top plate 4101 of the upper shell body 41 and the bottom plate 4201 of the lower shell body 42, the bulk intensity of the produced electrical connector can be effectively promoted. Moreover, with the surface contact engagement of between the support arm 413 of the upper shell body 41 and the top surface of the front shell 424 of the lower shell body 42, which reliably provides a fulcrum for delivering forces when the rear end of the wire 30 is oscillated, the internal mechanism of the electrical connector can be prevented from damage due to the oscillation of the wire 30, and therefore the reliability of the produced electrical connector can be promoted.

Referring to FIGS. 8, 9, 10 and 11, it is analytically understood that the wire 30 can be oscillated in any directions relative to X-axis and Y-axis. As shown in FIG. 10, when a tail of the forced wire 30 is oscillated downward, viz. the wire 30 is acted by a downward force, an upward force Fa is acted on a supporting point 'a' due to leverage effect; meanwhile, a downward force Fb is simultaneously produced due to the support arm 413 of the upper shell body 41 being pressed by the bent second buckling sheet 4241 of the lower shell body 42, thereby preventing the front end of the upper shell body 41 from warpage or disengagement. As shown in FIG. 11, when the tail of the forced wire 30 is oscillated upward, viz. the wire 30 is acted by an upward force, a leverage fulcrum is changed to the point 'a' now, so that a downward force Fa is acted on the point 'a' and the support arm 413 of the upper shell body 41 is pressed toward the front shell 424 of the lower shell body 42 due to leverage effect; meanwhile, a downward force Fb is simultaneously produced when the second buckling sheet 4241 of the lower shell body 42 is bent to press toward the support arm 413 of the upper shell body 41, thereby preventing the front end of the upper shell body 41 from warpage or disengagement. Further, due to both sides of the wire 30 to be clamped, along leftward and rightward orientations, by the engaging structures of the first buckling sheets 411 of the upper shell body 41 and the first buckle holes 421 of the lower shell body 42 which are configured on both sides of the rear ends of the shielding housing 40, an action force produced by the forced wire 30 is acted on the left-rear side plate 4104 and the right-rear side plate 4105 of the upper shell body 41 when the tail of the forced wire 30 is oscillated leftward or rightward, and a reaction force is simultaneously produced from the left-rear side plate 4104 and the right-rear side plate 4105 of the upper shell body 41 to lessen the oscillation amplitude of the wire 30, thereby preventing internal components from damage as excessive oscillation of the wire 30 is formed.

Figure 1:
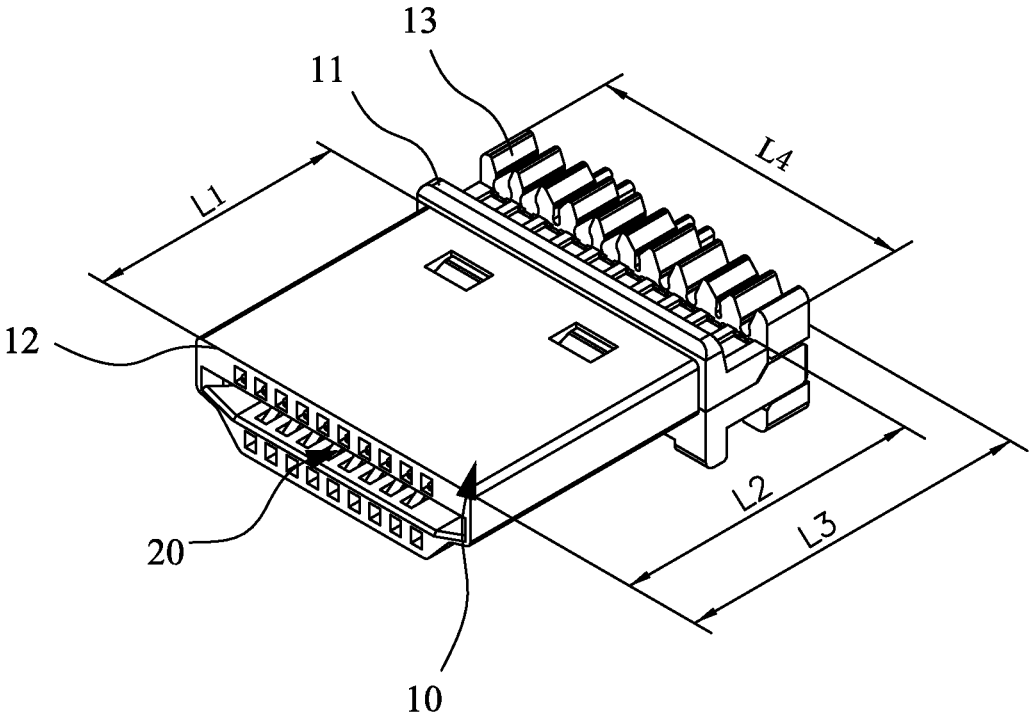
FIG. 1 is a schematic view illustrating a terminal set insertedly mounted in an insulating body of an embodiment of the invention.
Figure 2:
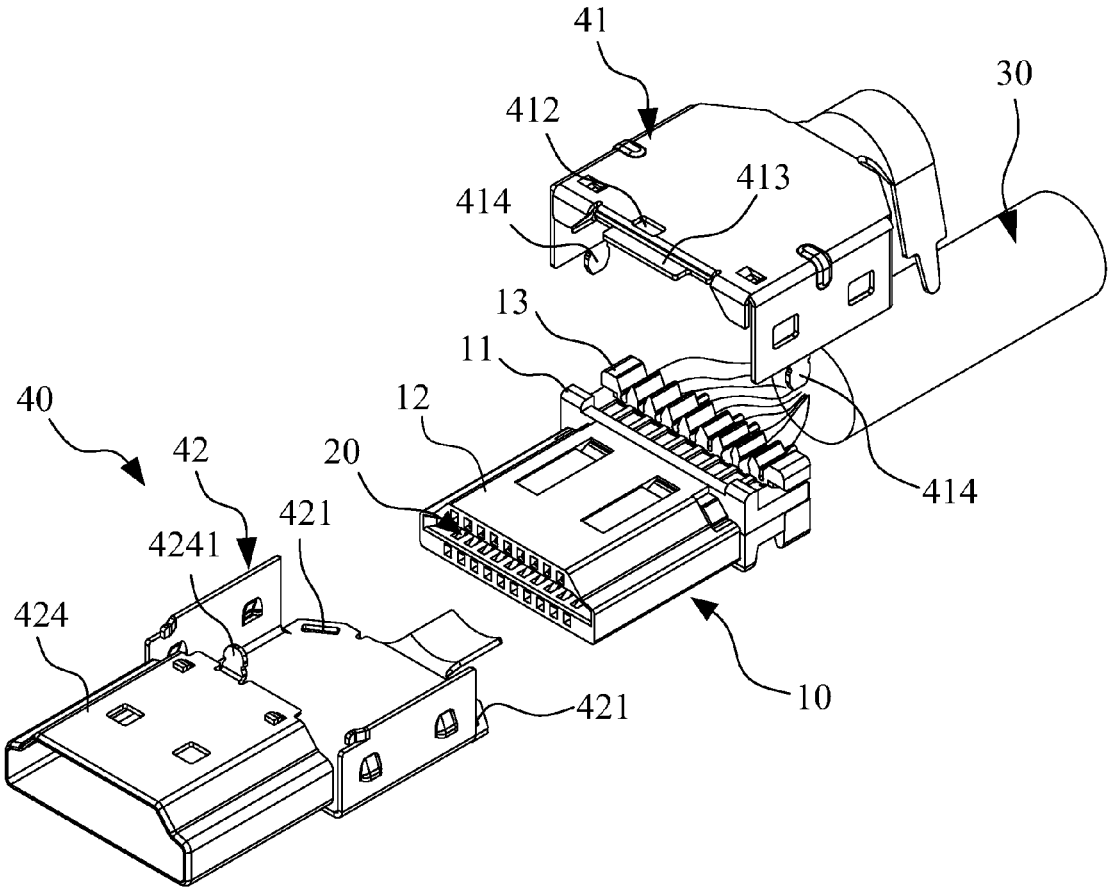
FIG. 2 is an exploded view illustrating the electrical connector in the embodiment of the invention.
Figure 8:
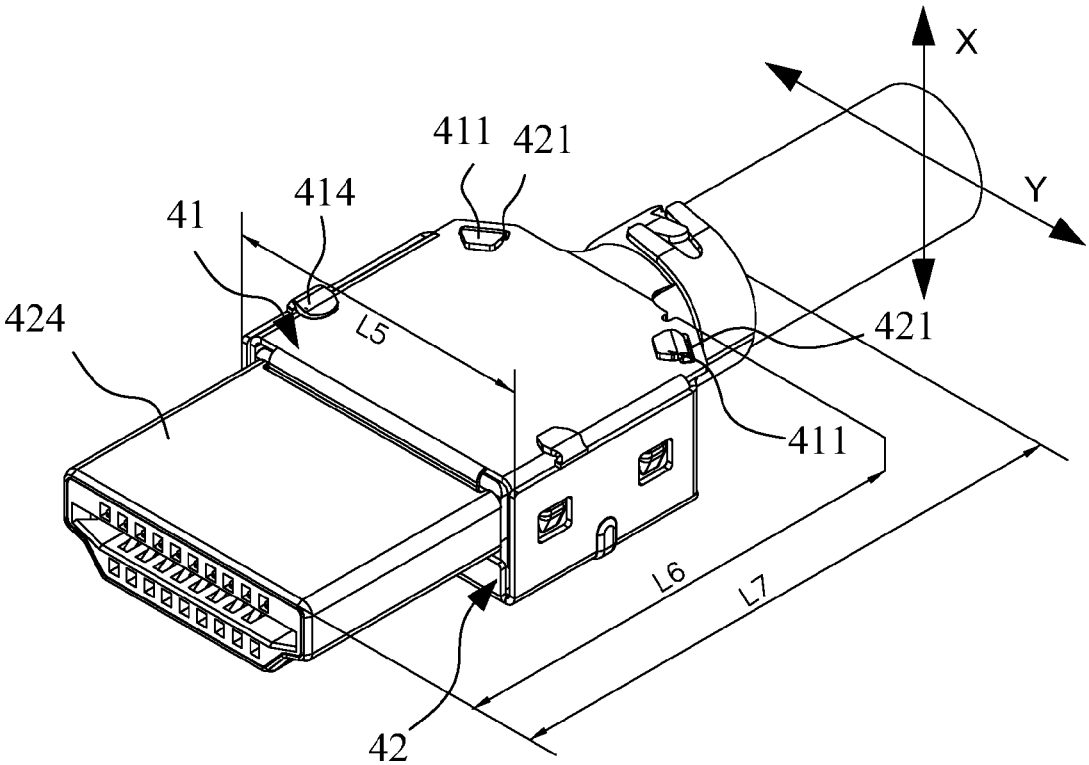
FIG. 8 is an assembled view of the electrical connector in the embodiment of the invention.
Figure 9:
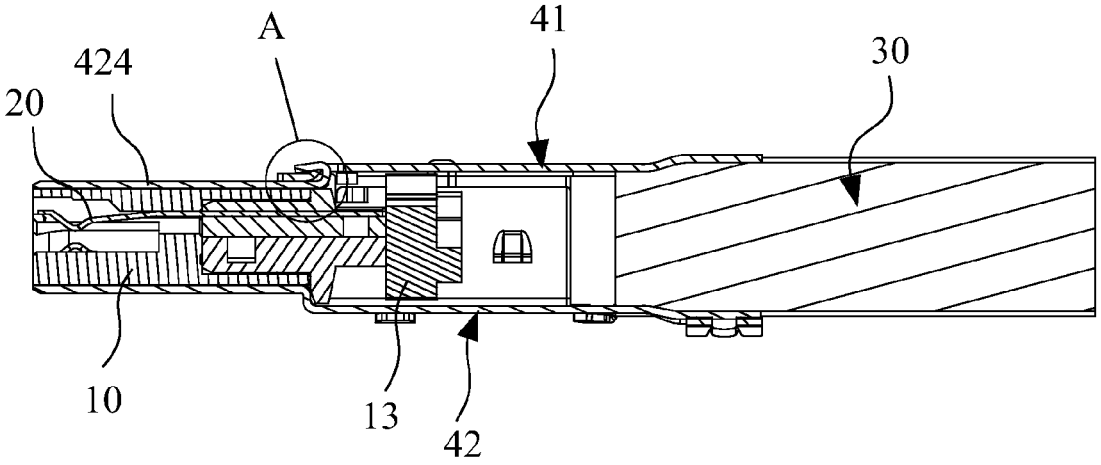
FIG. 9 is a sectional view of the electrical connector in the embodiment of the invention, taken along an engagement position of a second buckle point and a second buckle hole.

As shown in FIG. 1, the insulating body 10 comprises a base seat 11 and a tongue piece 12 which are integrally formed, a rear end of the base seat 11 is installed with a wire clip 13, the length L1 of the tongue piece 12 is not greater than 11 mm, the sum L2 of the lengths of the base seat 11 and the tongue piece 12 is not greater than 14 mm, the sum L2 of the lengths of the base seat 11, the tongue piece 12 and the wire clip 13 is not greater than 16 mm, and the width L4 of the wire clip 13. As shown in FIG. 8, the width L5 of the upper shell body 41 or the lower shell body 42 is not greater than 15.5 mm, the length L6 measured from a frontmost edge of the front shell 424 of the lower shell body 42 to a rear edge of the bottom plate 4201 of the lower shell body 42 is not greater than 23.9 mm, and the entire length L7 measured from a frontmost edge of the shielding housing 40 to a rearmost end of the lower shell body 42 is not greater than 28.9 mm. That is, the width of the upper shell body 41/the lower shell body 42 is not greater than 15.5 millimeters, the length measured from a front edge of the front shell 424 of the lower shell body 42 to the upper shell body 41/a rear edge of the bottom plate 4201 of the lower shell body 42 is not greater than 23.9 millimeters, and the entire length measured from a frontmost edge of the front shell 424 of the lower shell body 42 to the upper shell body 41/a rearmost end of the lower shell body 42 is not greater than 28.9 millimeters. The dimensions of the invention shown in FIGS. 1 and 8 are less than those of conventional products or electrical connectors, viz. L1=12 mm, L2=17 mm, L3=20 mm, L4=15 mm, L5=17.5 mm, L6=31 mm and L7=37 mm of conventional products. Thus, the HDMI electrical connector of the invention is smaller than conventional connector, which mainly realizes purpose of product miniaturization by improving the structure of the wire clip 13, viz. on the whole by equalizing the width L4 of the wire clip 13 to the width of the tongue piece 12. Consequently, instead of warping, bending and expanding the terminal slots, the distance between the two adjacent terminal slots can be reduced by directly and linearly extending the tongue piece 12 to the rear end of the terminal set 20. Besides, the purpose of product miniaturization can be realized by reducing the length and width of the shielding housing 40.

In conclusion, for the main designs of the invention, including forming the upper shell body 41 with the first buckling sheets 411 at the rear end thereof, forming the lower shell body 42 with the first buckle holes 421 at the rear end thereof, and engaging and riveting the first buckling sheets 411 of the upper shell body 41 and the first buckle holes 421 of the lower shell body 42 to form the upper and the lower shell bodies 41 and 42 into one piece, the bulk intensity of the produced electrical connector can be effectively promoted. Besides, by using the left-rear side plate 4104 and the right-rear side plate 4105 of the upper shell body 41 to block both sides of the wire 30 and to tightly press the wire 30 for avoiding excessive oscillation caused by the rear end of the clamped wire 30, the internal mechanism of the electrical connector can be prevented from damage due to the oscillation of the wire 30 and the reliability of the produced electrical connector can be promoted.

Further, by using the engaging structures of the second buckling sheet 4241 of the lower shell body 42 and the second buckle hole 412 of the upper shell body 41 to be configured on the mutual superposition position of the front shell 424 of the lower shell body 42 and the upper shell body 41, using the third buckling sheets 414 arranged on the left and right sides of the upper shell body 41 to be directly, inwardly bent so that the upper shell body 41 and the lower shell body 42 can be integrally riveted, and using the engaging structure of the convex points 422 to be configured on the left and right side plates of the lower shell body 42 and the engaging holes 415 to be configured on the left and right side plates of the upper shell body 41, the upper shell body 41 and the lower shell body 42 of the shielding housing 40 can be integrally formed by riveting along different orientations, and the bulk intensity of the produced electrical connector can be effectively promoted. In addition, by using the surface contact engagement of between the support arm 413 of the upper shell body 41 and the top surface of the front shell 424 of the lower shell body 42 to reliably provide a fulcrum for delivering forces when the rear end of the wire 30 is oscillated, the internal mechanism of the electrical connector can be prevented from damage due to the oscillation of the wire 30, and therefore the reliability of the produced electrical connector can be promoted.

Moreover, the HDMI electrical connector of the invention can have a smaller size than conventional connectors and realize purpose of product miniaturization, capable of satisfying customers' requirements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electrical connector, comprising an insulating body, a terminal set insertedly mounted in the insulating body, a wire connected to a rear end of the terminal set, and a shielding housing comprising an upper shell body and a lower shell body that are vertically corresponded, in which the lower shell body comprises a front shell that is integrally extended from a front end thereof to cover outside the insulating body to form a connection plug, and the upper and lower shell body of the shielding housing are mutually fastened to form a wired chamber so that to wrap a wired position of the terminal set and the wire, characterized in that two side flanges of a rear end of a bottom plate of the lower shell body are opened with first buckle holes, bottoms of a left-rear side plate and a right-rear side plate of the upper shell body are protrudingly formed with first buckling sheets, the first buckling sheets comprises folded parts and support parts penetrated through the first buckle holes of the lower shell body, in which, when bending the folded parts of the first buckling sheets, the support parts of the first buckling sheets are rivetedly pressed on an outer peripheral edge of the first buckle holes of the lower shell body, left and right sides of the wire are clamped by a left-rear side of a clamping part and a right-rear side of the clamping part of the upper shell body, and upper and lower sides of the wire are pressed by a top plate of the upper shell body and the bottom plate of the lower shell body, wherein a middle front side of the top plate of the upper shell body is configured with a second buckle hole, a middle support arm is extended from a front edge of the top plate of the upper shell body, a middle second buckling sheet extended upward from a rear edge of a top surface of the front shell of the lower shell body is engaged in the second buckle hole of the upper shell body, and the middle second buckling sheet is folded to reversely buckle and press a peripheral edge of the second buckle hole of the upper shell body so that the middle support arm of the upper shell body and the top surface of the front shell of the lower shell body are mutually abutted.

2. The electrical connector as claimed in claim 1 characterized in that the upper shell body comprises the top plate, a first left side plate and a first right side plate which are extended downward from two sides of the top plate, and third buckling sheets protrudingly arranged on bottoms of the first left side plate and the first right side plate, and the lower shell body comprises the bottom plate, a second left side plate and a second right side plate which are extended upward from two sides of the bottom plate, the second left side plate and the second right side plate of the lower shell body are outwardly clamped by the first left side plate and the first right side plate of the upper shell body, and the third buckling sheets of the upper shell body are folded on bottom edges of the second left side plate and the second right side plate of the lower shell body to reversely buckle the bottom plate of the lower shell body.

3. The electrical connector as claimed in claim 2 characterized in that the first left side plate and the first right side plate of the upper shell body are configured with a plurality of engaging holes, the second left side plate and the second right side plate of the lower shell body are configured with a plurality of convex points which are engaged in the corresponding engaging holes of the upper shell body.

4. The electrical connector as claimed in claim 2 characterized in that both sides of a front end of the top plate of the upper shell body is concaved downward with two concave points which are respectively distanced from the first left side plate and the first right side plate with clearances, and front sides of top edges of the second left side plate and the second right side plate of the lower shell body are configured with guide elastic pieces which are slidably embedded in the clearances of the upper shell body.

5. The electrical connector as claimed in claim 1 characterized in that the insulating body comprises a base seat and a tongue piece which are integrally formed, a rear end of the base seat is installed with a wire clip, the length of the tongue piece is not greater than 11 millimeters, the sum of the lengths of the base seat and the tongue piece is not greater than 14 millimeters, the sum of the lengths of the base seat, the tongue piece and the wire clip is not greater than 16 millimeters, and the width of the wire clip.

6. The electrical connector as claimed in claim 5 characterized in that the width of the upper shell body/the lower shell body is not greater than 15.5 millimeters, the length measured from a front edge of the front shell of the lower shell body to the upper shell body/a rear edge of the bottom plate of the lower shell body is not greater than 23.9 millimeters, and the entire length measured from a frontmost edge of the front shell of the lower shell body to the upper shell body/a rearmost end of the lower shell body is not greater than 28.9 millimeters.

* * * * *